US005803272A

United States Patent [19]

Jimenez et al.

[11] Patent Number: 5,803,272

[45] Date of Patent: Sep. 8, 1998

[54] DOCUMENT HANGER APPARATUS AND METHOD

[75] Inventors: Dennis V. Jimenez, 2033 Greenstone Trail, Carrollton, Tex. 75010; Clarence D. Zierhut, Richardson; Jerry W. Harrison, Garland, both of Tex.

[73] Assignee: Dennis V. Jimenez, Carrollton, Tex.

[21] Appl. No.: 721,001

[22] Filed: Sep. 26, 1996

[51] Int. Cl.[6] ..... A47F 7/16

[52] U.S. Cl. ..... 211/48; 211/47

[58] Field of Search ..... 248/447.1; 211/47, 211/48, 96, 113

[56] References Cited

U.S. PATENT DOCUMENTS

| | | | |
|---|---|---|---|
| D. 248,484 | 7/1978 | Hedstrom et al. | D19/91 |
| D. 289,115 | 4/1987 | Spicer | D6/462 |
| 383,975 | 6/1888 | Neuville | 211/47 |
| 564,451 | 7/1896 | Reid | 211/47 |
| 633,147 | 9/1899 | Nolen . | |
| 643,749 | 2/1900 | Mertz . | |
| 855,464 | 6/1907 | Leonard | 211/47 |
| 1,614,779 | 1/1927 | Dumont . | |
| 2,252,402 | 8/1941 | Kern | 45/2 |
| 2,876,907 | 3/1959 | Amberg | 211/11 |
| 4,856,660 | 8/1989 | Selwyn-Smith | 211/46 |

FOREIGN PATENT DOCUMENTS

| | | |
|---|---|---|
| 553064 | 6/1932 | Germany . |
| 1093329 | 6/1952 | Germany . |

*Primary Examiner*—Peter M. Cuomo
*Assistant Examiner*—Gerald A. Anderson
*Attorney, Agent, or Firm*—Steven W. Smith

[57] ABSTRACT

Disclosed is the apparatus and method for hanging and storing documents. The invention utilizes a substantially planar base, a hanging brace, a substantially planar hub longitudinally extending from the base and an arm having a first end adapted to slidably accept the inner circumferential edge of the hub. A document pocket is adapted to accept the arm such that the document pocket is suspended by the arm. The document pocket is sufficiently translucent to allow viewing of a document when positioned in the document pocket.

16 Claims, 3 Drawing Sheets

DOCUMENT HANGER APPARATUS AND METHOD

TECHNICAL FIELD

This invention relates to document hangers and methods of storing and displaying documents and more particularly to document hangers mountable on office cubicles or conventional walls.

BACKGROUND OF THE INVENTION

In the past it has been common to suspend a paper filing device from a wall or other substantially vertical support to allow a user to file documents for convenient access or write notes on documents suspended from the device.

For example, U.S. Pat. No. 1,614,779, issued to Dumont, discloses a directory rack for temporarily receiving cards. The device discloses a rack frame consisting of a back plate having channel side rails engaged by flexible card bars having end fingers and receiving fingers. The card bars can be removed by flexing middle portions of the flexible card bars to spring the end fingers out of engagement with the channel side rails. The cards lie flat approaching a vertical plane.

Also, U.S. Pat. No. 2,252,402, issued to Kern, discloses a filing unit to facilitate suspension or vertical filing. This filing unit is disclosed as being mounted within a cabinet. This device discloses supports for mounting filing units in a cabinet. The supports extend transversely along the cabinet for accepting a hanger arms having suspension members in a fixed relation. File contents, such as sheets, are secured on the hanging arms.

But such devices are cumbersome in size, weight and use. First, such devices are not suited for suspending documents from fabric-covered partitions or cubicles common in modern offices. Second, vertical filing systems do not allow "hands-free" use to perform other tasks while viewing the documents. Third, filing systems with fixed arm supports do not allow for compact storage of suspended document while not in use.

There has been a long felt need for a document hanger for use in modern offices having cubicles defining the employees' workspace which is lightweight, readily used on a variety of cubicle or wall surfaces, and allows compact filing of suspended documents.

SUMMARY OF THE INVENTION

Therefore, a document hanger is provided which utilizes a substantially planar base, a hanging brace, a substantially planar hub longitudinally extending from the base and an arm having a first end adapted to slidably accept an inner arcuate edge of the hub. A document pocket is adapted to accept the arm such that the document pocket is suspended by the arm. The document pocket is sufficiently translucent to allow viewing of a document when positioned in the document pocket.

BRIEF DESCRIPTION OF THE DRAWINGS

The accompanying figures are incorporated into and form a part of the specification to illustrate examples of the present inventions. These drawings together with the description serve to explain the principles of the inventions. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawings in which.

DETAILED DESCRIPTION OF THE PREFERRED EMBODIMENT

Figure 1:
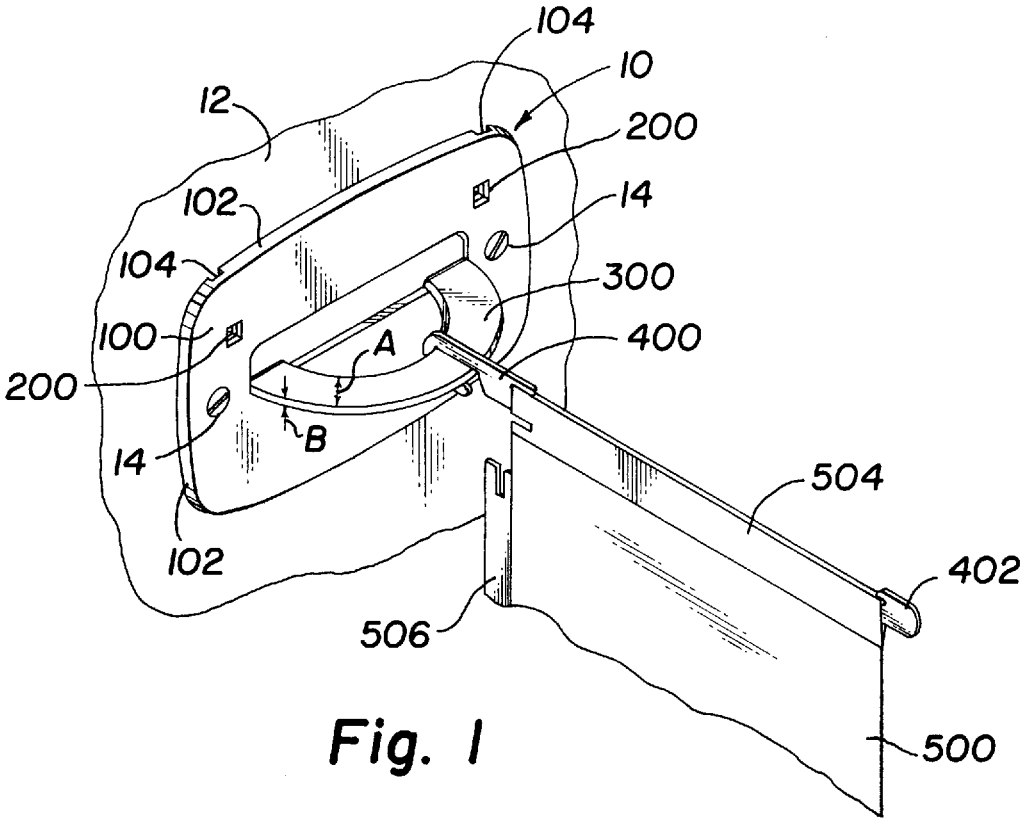
FIG. 1 perspective view of the present invention mounted to a vertical support positioned with an arm and document pocket.

The present inventions will be described by referring to drawings showing and describing examples of how the inventions can be made and used. In these drawings the same reference characters are used throughout the several views to indicate like or corresponding parts.

Referring to FIG. 1, a document hanger is shown generally designated by the numeral 10. Document hanger 10 has a substantially planar base 100, a mount hanging brace 200, a substantially planar hub 300, an arm 400 and a document pocket 500. Document hanger 10 is shown mounted to a vertical support 12 through the mount, which is either hanging brace 200, screw holes 14 or adhesive mounts 16 (best shown in FIG. 4) or a combination thereof. Hanging brace 200 is used to mount the document hanger to a fabric-covered wall-partition, such as those commonly used in office cubicles. Document hanger 10 can also be mounted to vertical supports through screw holes 14, or through adhesive mounts 16. Adhesive mounts 16 can be made of materials which take advantage of the materials in the wall-partitions. For example, if the hanger 10 is mounted to a flat, non-metallic surface, the adhesive mount can be a form of contact cement. If the hanger 10 is mounted to a ferrous or metallic surface, then the adhesive mount can be a magnetic strip. And with fabric covered partitions, adhesive mount 16 can be a velcro strip for greater gripping contact in combination with the hanging brace 200.

Shown in FIG. 1 is a lip portion 102 around the periphery of planar base 100. Lip portion 102 has a depth of about one-eighth inch (about 3.18 mm) and a foot portion 103 (best shown in FIG. 4) having a width of about one-sixteenth inch (about 1.59 mm). Defined in lip portion 102 are slots 104. Slots 104 are can be arcuate or a notch having sufficient size to allow paper clip 208, shown in FIG. 6, access to be installed in hanging brace 200. Document hanger 10 is formed of a durable, rigid and lightweight material such as a plastic or a lightweight metal alloy. Preferably, document hanger 10 is formed of plastic.

Figure 2:
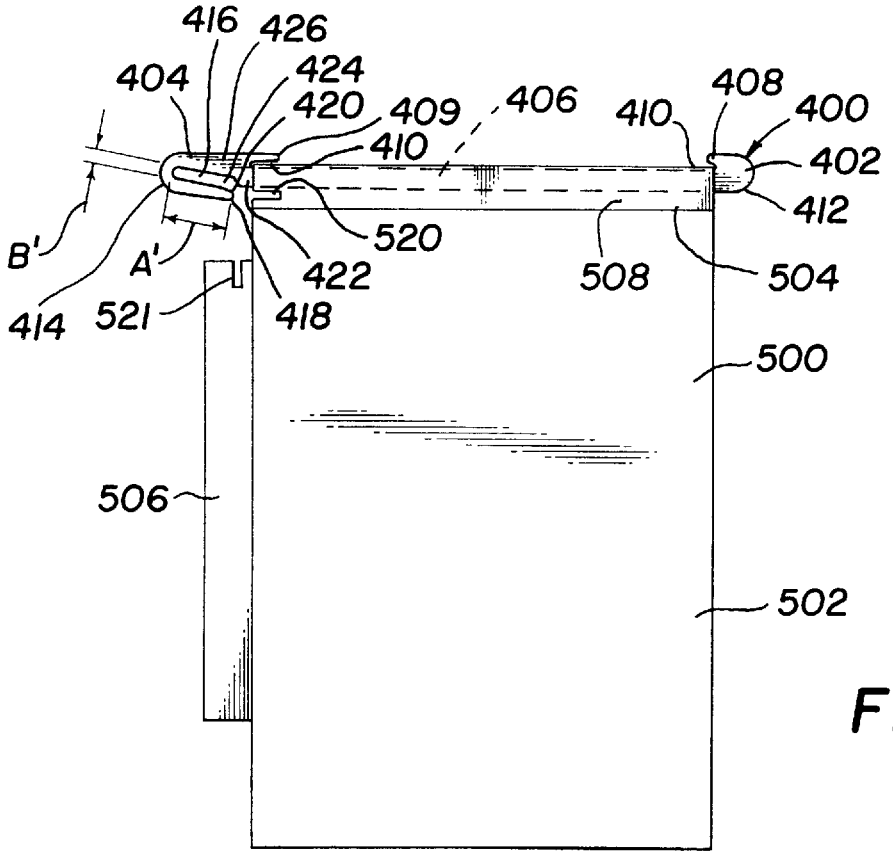
FIG. 2 a plan view of a document pocket mounted and an arm of the present invention in a portrait page orientation.

Referring to FIG. 2, arm 400 is shown suspending document pocket 500 in a portrait orientation. Arm 400 has pocket retaining member 402 and hub engaging member 404. Beam member 406 extends between retaining member 402 and hub engaging member 406. Beam member 406 has a length to accommodate the size of a document defined by pocket 500, which sets out the document sizes which can be accommodated by the document hanger 10. In the embodiment shown in FIG. 2, beam member 406 has a length of about 8.5 inches (about 21.59 cm).

Retaining member 402 and engaging member 404 each have projecting fingers 408 and 409, respectively. The distance between the tips of fingers 408 and 409 is less than the length of first and second sleeves 504 and 506. Between projecting fingers 408 and 409 and beam member 406 are slots 410. Slots 410 have a width sufficient to accept the sleeves 504 or 506. Arcuate outer edge 412 terminates retaining member 402.

With base portion 426, engaging member 404 has finger 414 that defines hub slot 416 with base portion 426. Hub slot 416 has depth A' and width B' which is at least the depth A and width B of hub 300, illustrated shown in FIG. 1. Hub slot 416 has a sloped orientation, or bias, with respect to a longitudinal axis of beam member 406. The sloped orientation of hub slot 416 serves to minimize sagging of arm 400 when mounted on hub 300. Sagging is caused by the gap between the depth and width of slot 416 and hub 300. Finger 414 extends to tip 418 having a ramped inner-face surface 420. Substantially vertical ledge 422 is adjacent finger tip 418, forming a slot entry 424 having a dimension less than depth A'. Arm 400 is made of a durable lightweight material which can be temporarily deformed in the presence of a force urging finger 414 away from base portion 426. Such a material is a plastic, a lightweight metal alloy, or the like.

Still referring to FIG. 2, document pocket 500 has a body portion 502. Body portion 502 can be formed by a length of plastic sheet folded on itself and heat-sealed or otherwise sealed along a mating edge. Preferably, body portion 502 is sufficiently translucent such that the contained document can be readily viewed. First sleeve 504 and second sleeve 506 are sized to accept retaining member 402 through sleeve slots 520 and 521. Sleeves 504 and 506 are positioned on adjacent sides of body portion 502 such that they are in a substantially orthogonal relationship to each other. Lip 508 forms an opening to accept a document into a cavity formed in body portion 502. In the preferred embodiment, sleeves 504 and 506 have lengths sufficient to accommodate the length of beam 406 which is about 8.5 inches from entry edge 512. Sleeve slots 520 and 521 allow sleeves 504 and 506 to pass between projecting fingers 408 and 409, respectively, and into slots 410.

It should be noted that pocket 500 can be sized to accommodate various sizes of paper, or documents. For example, the embodiment shown is sized for letter-sized documents. Letter-sized documents have dimensions of about 8.5-by-11 inches (about 21.59-by-27.95 cm). Pocket 500 can be sized to accommodate legal-size paper with a dimension of about 8.5-by-14 inches (about 21.59-by-35.56 cm).

Figure 3:
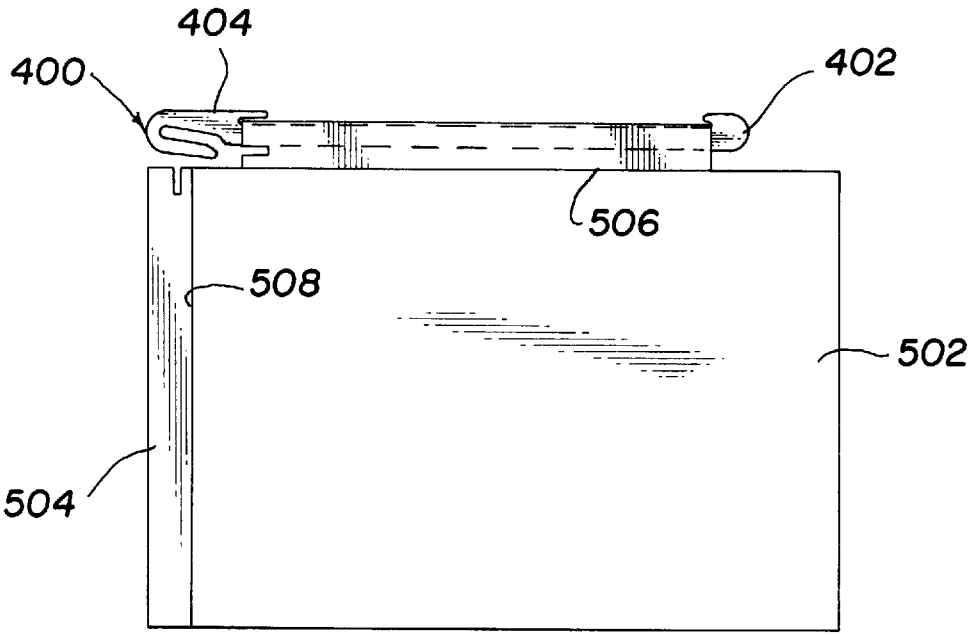
FIG. 3 plan view of a document pocket mounted and an arm of the present invention in a landscape page orientation.

Referring to FIG. 3, document pocket 500 is shown in a landscape orientation. This orientation is desirable when text or images are printed "sideways"—that is, the width of the image of the page is greater than the depth. In contrast, portrait orientation is a vertical print orientation in which a document is printed across the narrower dimension of a rectangular sheet of paper. This is the print orientation of most letters, reports, and other such documents.

Figure 4:
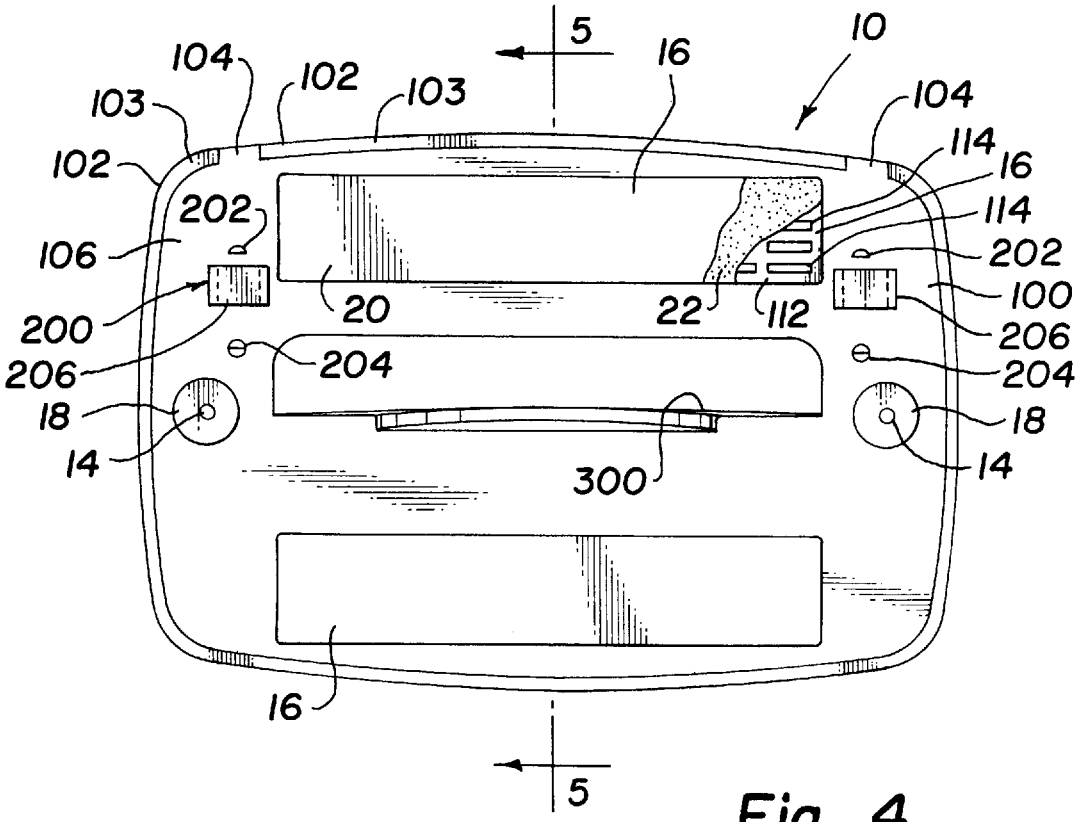
FIG. 4 a plan view of a document base of the present invention showing structures for mounting the document hanger to a vertical support.

Referring to FIG. 4, a view from the rear or first face of base 100 is shown. Body depression 106 is formed by lips 102. Document hanger 10 can be supported by, or installed to a vertical support with a hanging brace 200, screw holes 14 and adhesive mounts 16, or a combination thereof. As shown, screw holes 14 extend through bosses 18. Bosses 18 preferably extend from body depression 106 to a depth or height substantially similar to that of lips 102 for additional surface contact with the vertical support 12 shown in FIG. 1. But it should be noted that bosses 18 can vary in height to achieve a substantially similar securing effect with vertical support 12. Similarly, supports 14, 16 and 200 can be extruded or molded to protrude from the base 100 to a depth substantially the same as lips 102.

Still referring to FIG. 4, adhesive mounts 16 are shown implementing a contact adhesive. The contact adhesive has a protective film layer 20. An contact adhesive layer 22 lies beneath protective layer 20. Adhesive layer 22 is secured to base 100 through adhesive base 112. The adhesive base extends about one-sixteenth inch (about 1.59 mm) from body depression 106. Adhesive base 112 is of a substantially rectangular shape defining pockets 114. Pockets 114 reduce the amount of raised mass involved in molding the adhesive mount 16. The pockets limit surface irregularities formed when plastic materials cool.

Figure 5:
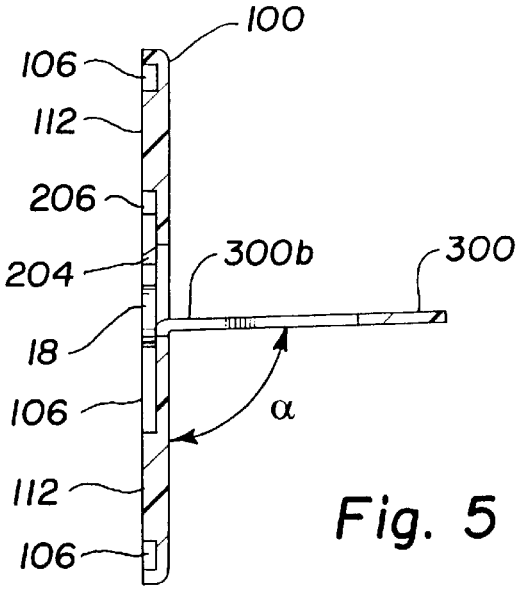
FIG. 5 is a sectional view taken along line 5—5 of FIG. 4 illustrating an upward bias of the hub of the present invention.

Referring to FIG. 5, planar hub 300 extends from base 100 at an upward bias. The upward bias of hub 300 is represented by angle $\alpha$ between a reference plane defined by the second face and the reference plane defined by the bottom surface of hub 300. Preferably, angle $\alpha$ has a degree sufficient to compensate for a downward force on hub 300 caused by the weight associated with arm 400, document pocket 500, and documents which can be contained within document pocket 500. Angle $\alpha$ can be adjusted according to the material used for the document hanger 10. Angle $\alpha$ can be a value from about 90-degrees to about 120-degrees. In the preferred embodiment, the document hanger is made of a plastic with a thickness of about one-sixteenth inch (1.59 mm), and an angle $\alpha$ of about 95-degrees.

The upward bias of hub 300 also limits the tendency of suspended documents from gathering at a midpoint of the hub. Otherwise, when the suspended documents gather at the midpoint of the hub, the content of a selected document is not readily viewed. As angle $\alpha$ is increased, the documents are inclined to gather to either side 300*a* or 300*b*, respectively, of hub 300.

When the vertical support 12 is non-ferrous or does not have a fabric covering, screws extending through screw holes 14 can threadingly secure the document hanger to the vertical support. Similarly, adhesive mounts 16, with a contact adhesive, can be used on such vertical supports. When the document hanger 10 is suspended from a fabric-covered vertical support, the adhesive mount 16 can be velcro to increase the surface contact of hanger 10 when used with hanging braces 200.

Figure 6:
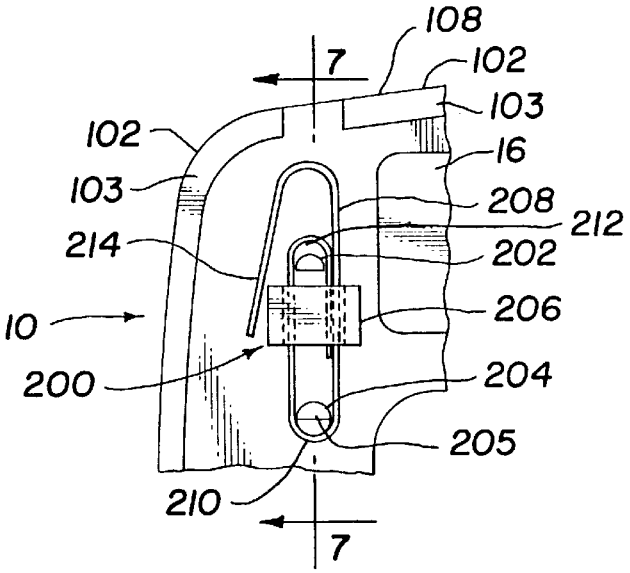
FIG. 6 is a fragmentary view illustrating a hanging brace of the apparatus of the present invention with a paper clip installed.

Referring to FIG. 6, shown in greater detail is hanging brace 200. For greater clarity, one hanging brace is illustrated, but it should be noted that a second hanging brace is distally placed on base 100. Both hanging brace is employed to hang the document hanger 10 on a vertical support 12. Hanging brace 200 is positioned adjacent top edge 108.

Hanging brace 200 has a first post 202 and a second post 204. Band member 206 is positioned between first post 202 and second post 204. Extending across a portion of second post 204 is inclined ramp surface 205. Band member 206 is of a size to accept paper clip 208, best shown in FIG. 6, and is positioned closer to first post 202. First post 202 has a substantially half-circle cross section, creating at least a sufficient access-space for paper clip 208 to pass between band member 206 and first post 202.

The size of the hanging brace 200 can vary to accommodate larger- or smaller-sized paper clips capable of supporting the weight associated with document hanger 10. Preferably, clip 208 is a No. 1 size. Second post 206 is adapted to accept the curve formed in lower end 210. First post 202 and second post 204 are spaced apart and contained between first end 210 and inner curve 212.

Paper clip 208 is placed in hanging brace 200 by placing lower end 210 over first post 202. The remaining portion of paper clip 208 is extending through slot 104. It should be noted that paper clip 208 can be sufficiently resilient such that slot 104 is not necessary. The term resilient as used describes a material which can be temporarily deformed upon application of sufficient force yet return to a substantially the same form once the force is removed. Paper clip 208 is urged towards second post 206 through band member 206. Lower end 210 of paper clip 108 engages ramp 205. Ramp 205 deflects lower end 210 away from body depression 106 and over second post 204 when paper clip 108 is urged in a generally downward direction through band member 206. Band member raised above body depression 106 sufficient to allow paper clip 208 to pass therethrough. Once paper clip 108 is urged past the circumferential edge of second post 204, the lower end 210 is no longer deflected away from body depression 106, but rests adjacent body depression 106.

Figure 7:
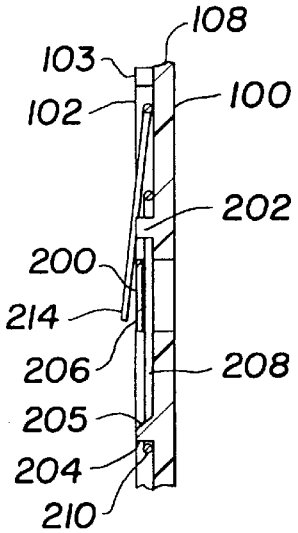
FIG. 7 is a fragmentary sectional view illustrating the hanging brace of the apparatus of the present invention taken along line 7—7 of FIG. 6.

Paper clip end member 214 is urged outwardly to form a hook appendage extending past lip 102, best illustrated in FIG. 7. Hanging brace 200 is of use when the document hanger 10 is for a vertical support such as a fabric-covered wall or other such material. End member 214 pierces the fabric, suspending document hanger 10 from vertical support 12 by hanging braces 200. While suspended from the wall, paper clip 208 is urged against band member 206 through a torsional moment distributed along the plane defined by paper clip 208 from end member 214.

Referring back to FIG. 1, document hanger 10 is installed to vertical support 12. Document hanger 10 allows a user access to important and frequently referenced documents. In a typical workplace or home, the user unnecessarily spends time searching for these documents in filing cabinets or other storage areas. Document hanger 10 provides a central place to keep the important documents while also protecting them. Ready access to the documents is provided by document hanger 10, which can be mounted to conventional walls using screw holes 14, office cubical walls using hanger braces 200, or substantially flat vertical surfaces using adhesive mounts 16.

SECOND EMBODIMENT

Figure 8:
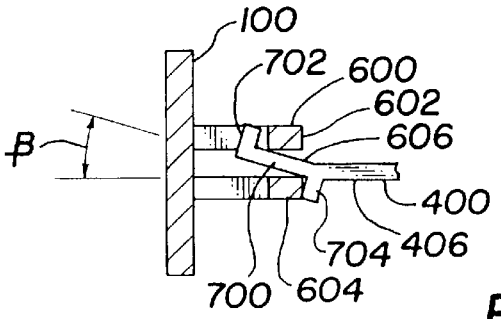
FIG. 8 is sectional view illustrating a second embodiment of a hub with an arm installed.

Referring to FIG. 8, a second embodiment of a hub and arm is shown. Hub 600 has a first bracket 602 and a second bracket 604 extending from base 100. First and second hub brackets 602 and 604, respectively, are substantially semicircular and are substantially aligned with each other, forming a substantially semicircular slot 606 therebetween. Beam member 406 of arm 400 has hub retaining member 700 having first and second fingers 702 and 704 extending in opposing directions therefrom, respectively. Angle β is formed between the reference planes provided by hub retaining member 700 and beam member 406. Angle β has a value such that beam member 406 is maintained substantially horizontally when installed in hub brackets 602 and 604. Preferably, angle β has a value of about 160-degrees. As gravitational force urges beam member 406 downward, upper surface 706 of retaining member 700 pivotally engages first hub bracket 602. In the engaged position, second finger 704 is urged against second hub bracket 604, providing a fulcrum to support and sustain arm 400 in a substantially horizontal position.

The embodiments shown and described above are only exemplary. Many details which are omitted are well known in the art such as descriptions of physically fabricating the base with the hub and the like. Therefore, many such details are neither shown or described. It is not claimed that all the details, parts, elements, or steps described and shown were invented herein. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of the parts within the principles of the inventions to the full extent indicated by the broad general meaning of the terms used in the attached claims. The restrictive description and drawings of the specific examples do not point out what an infringement of this patent would be, but are to provide at least one explanation how to make and use the inventions. The limits of the inventions and the bounds of the patent protection are measured by and defined by the following claims.

What is claimed is:

1. An apparatus for suspending documents from a substantially vertical support, the apparatus comprising:

a substantially planar base with a first face and a second face;

a mount attached to said first face, said mount adapted to suspend said planar base from the substantially vertical support;

a substantially planar hub longitudinally ending from said second face, said hub having a depth and a width, and an inner arcuate edge forming an aperture between the inner arcuate edge and said second face;

a substantially horizontally supported beam having first and second opposing ends, said first end adapted to slidably accept said inner arcuate edge of said hub, said first end having a hub slot with a height and length that are sufficiently larger than the depth and width of said hub to provide a loose fit when said first end slidably accepts said inner arcuate edge of said hub, said beam having a length extending substantially horizontally in an outward direction beyond the hub; and a document pocket having a sleeve with a width that is less than the length of the beam, said sleeve being adapted to accept said beam such that said document pocket is suspendable from said beam.

2. The apparatus as defined in claim 1 wherein said first face has a lip about a periphery of said first face.

3. An apparatus for suspending documents from a substantially vertical support, the apparatus comprising:

a substantially planar base with a first face and a second face;

a hanging brace attached to said first face, said hanging brace adapted to suspend said planar base from the substantially vertical support, said hanging brace comprising:

first and second spaced apart posts;

a band member between said first and second posts and spaced apart from said first face; and a hooking means mounted between the first and second posts and between the band member and the first face;

a substantially planar hub longitudinally extending from said second face, said hub having a depth and a width, and an inner arcuate edge forming an aperture between the inner arcuate edge and said second face;

a substantially horizontally supported beam having first and second opposing ends, said first end adapted to slidably accept said inner arcuate edge of said hub, said beam having a length extending substantially horizontally in an outward direction beyond the hub; and a document pocket having a sleeve with a width that is less than the length of the beam, said sleeve being adapted to accept said beam such that said document pocket is suspendable from said beam.

4. The apparatus as defined in claim 1 wherein said pocket comprises a first sleeve on a periphery of said pocket for orienting said pocket in a first orientation when suspended from said beam.

5. The apparatus as defined in claim 4 further comprising a second sleeve on an orthogonal periphery of said pocket with respect to said first sleeve, said second sleeve for orienting said pocket in a second orientation when suspended from said beam.

6. The apparatus as defined in claim 1 wherein said hub has an upward slope in a range of 90 to 120 degrees with respect to said second face of said planar base.

7. The apparatus as defined in claim 1 wherein said hub slot is biased slanted upward toward the first end a sufficient amount to orient said beam in a substantially horizontal position when said first end slidably and loosely accepts said inner arcuate edge of said hub.

8. A document hanger as defined in claim 1 further comprising a second substantially planar hub spaced apart from said first hub and extending from said second face in a plane substantially parallel to said first hub, said second hub having an inner arcuate edge forming an aperture between the anner arcuate edge and said arcuate edge.

9. A document hanger as defined in claim 8 wherein said first end of said beam has a hub retaining member with first and second spaced-apart and oppositely extending fingers.

10. A document hanger as defined in claim 8 wherein the apertures of said first and said second hubs have substantially similar dimensions.

11. The apparatus as defined in claim 1 wherein said first end has a projecting finger extending substantially parallel to said beam, said projecting finger and said beam defining a slot therebetween.

12. The apparatus as defined in claim 11 wherein said second end of said beam has a second projecting finger extending substantially parallel to said beam, said second projecting finger and said beam defining a second slot therebetween.

13. The apparatus as defined in claim 1 wherein said pocket is a sufficiently translucent material such that contents within said pocket can be viewed.

14. The apparatus as defined in claim 1 wherein said mount attached to said first face is a hanging brace.

15. The apparatus as defined in claim 1 wherein said mount attached to said first face is a plurality of screws extending through said planar base.

16. The apparatus as defined in claim 1 wherein said mount attached to said first face is an adhesive mount.

* * * * *